United States Patent [19]

Hansen

[11] Patent Number: 4,881,744

[45] Date of Patent: Nov. 21, 1989

[54] ELECTRONICALLY SCORED DART GAME HAVING FRONT OPENING SERVICE DOOR

[75] Inventor: Norman C. Hansen, Delanco, N.J.

[73] Assignee: Merit Industries, Inc., Bensalem, Pa.

[21] Appl. No.: 166,353

[22] Filed: Mar. 10, 1988

[51] Int. Cl.[4] ..... F41J 5/04; A47B 88/00

[52] U.S. Cl. ..... 273/376; 312/328

[58] Field of Search ..... 273/376; 312/315, 313, 312/328, 282; 108/149; 298/240, 240.4; 194/350; 221/281

[56] References Cited

U.S. PATENT DOCUMENTS

| | | | |
|---|---|---|---|
| 577,888 | 3/1897 | Thomas | 312/313 |
| 3,010,556 | 11/1961 | Wawrzonek | 194/350 |
| 4,561,660 | 12/1985 | Zammuto | 273/376 |

*Primary Examiner*—Edward M. Coven
*Assistant Examiner*—Benjamin Layno
*Attorney, Agent, or Firm*—Panitch Schwarze Jacobs & Nadel

[57] ABSTRACT

An electronically scored dart game includes a service door for providing access to the interior of the game housing from the front of the housing. The service door is formed of at least a portion of the front housing surface, including the dart board, and has an upper end and a lower end. The service door is hinged to the housing along at least a portion of the lower end. The service door is pivotable about the hinge for movement between a generally vertical operational position and a service position in which the service door extends outwardly from the front surface of the housing at a predetermined angle of less than 180 degrees. In the preferred embodiment, the predetermined angle is approximately 90 degrees. At least one flexible member is provided for preventing the service door from pivoting to a position exceeding the predetermined angle. When the service door is in the service position, gravity causes movable target plates within the dart board to engage stops within the dart board supporting structure to prevent the target plates from moving out of the supporting structure.

7 Claims, 4 Drawing Sheets

ELECTRONICALLY SCORED DART GAME HAVING FRONT OPENING SERVICE DOOR

BACKGROUND OF THE INVENTION

The present invention relates generally to electronically scored dart games and, more particularly, to an electronically scored dart game having a service door for providing access to the interior of the game housing from the front of the housing.

Electronically scored dart games are generally well known in the art and are commercially available from a variety of sources, including Merit Industries, Inc., the assignee of the present invention. Such dart games generally comprise a cabinet or housing with a decorative front surface which includes a specialized dart board adapted to receive and hold one or more darts having a tip made of flexible plastic with a relatively blunt point. Darts of this type closely resemble conventional metal tipped darts in appearance, flight characteristics and target-striking characteristics, but are much safer in that they are incapable of piercing a person's skin or causing damage to walls or other surroundings adjacent to the dart board.

To enable such plastic tipped darts to be captured by the target dart board, the dart board is comprised of a plurality of generally vertically extending target plates. The target plates, which are usually formed of a plastic material, are arranged in an array or pattern which establishes scoring areas, substantially the same as the scoring areas of a traditional dart board. Each target plate has a front surface, which includes a plurality of generally circular openings sized for receiving and holding the tip of a plastic tipped dart. The target plates are each independently slideably supported within a surrounding support structure, so that when the tip of a dart is received within a target plate, the force of the moving dart results in the target plate moving rearwardly with respect to the support structure. Each target plate has corresponding electrical contacts combined into a switch matrix and mounted on a surface behind the target plates, which generate an electrical signal which indicates a score when the target plate slides rearwardly after receiving a dart. Electronics associated with the game sense each such score signal, adds up the score for each player and provides an indication of each player's score on a visual display, such as a plurality of lights, light-emitting diodes or a cathode ray tube.

While prior art electronically scored dart games of this type are a very effective, safe alternative to traditional dart boards and have become increasingly popular, they have a common service-related problem. The prior art electronically scored dart games of this type are traditionally serviced from the rear of the machine, primarily in order to avoid detrimentally affecting the aesthetic appearance of the front of the machine. Consequently, when servicing the machine, it is usually necessary for a servicing technician to slide or otherwise move the machine away from a wall or other structure and to remove an access panel on the rear of the machine.

It has been found that movement of the machine can sometimes detrimentally affect the delicate contacts, as well as the electronics associated with the machine. In addition, because the target plates must have the ability to slide freely towards the rear of the machine, when servicing the target assembly of the machine, it is not uncommon for many of the target plates to actually fall out of the supporting structure. The individual target plates must then be returned to the supporting structure, a procedure which is relatively time-consuming. In addition, whenever a machine of this type is moved, there exists the possibility that the machine could tip over, resulting in substantial damage to the machine.

Some manufacturers have overcome some of the problems associated with machine servicing by providing a service door on the front of the machine. In such cases, the service door generally utilizes a hinge which extends generally vertically along one side of the machine and a latch on the other side of the machine. While the use of such a front access service door is beneficial, it still suffers from the drawback of permitting the target plates to fall out of the supporting structure during servicing, resulting in additional servicing time and inconvenience to service personnel.

The present invention overcomes the drawbacks associated with the servicing of prior art electronically scored dart games by providing a service door in the front of the housing. The service door is hinged along its bottom edge so that when open it pivots from a generally vertical position to an outwardly extending angled position. In this manner, service personnel are able to gain convenient access to the interior of the machine without having to move the machine. In addition, no target plates inadvertently fall out of the supporting structure because the target plates are held in place by gravity. The present invention also permits the dart game to be completely serviced without the need for moving the game away from the wall, thereby avoiding potential problems and inconvenience associated with the moving of the prior art machines.

SUMMARY OF THE INVENTION

Briefly stated, the present invention comprises a service door for providing access to the interior of a housing for an electronically scored dart game from the front of the housing. The service door is formed of at least a portion of the front housing surface, including the dart board and has an upper end and a lower end. The service door is hinged to the housing along at least a portion of the lower end. The service door is pivotable about the hinge for movement between a generally vertical operational position and a service position in which the service door extends outwardly from the front surface of the housing at a predetermined angle of less than 180 degrees. Means are provided for preventing the service door from pivoting to a position exceeding the predetermined angle. When the service door is in the service position, gravity causes movable target plates within the dart board to engage a stop means within the dart board support structure, thereby preventing the target plates from moving downwardly and out of the support structure.

BRIEF DESCRIPTION OF THE DRAWINGS

The foregoing summary, as well as the following detailed description of a preferred embodiment of the invention, will be better understood when read in conjunction with the appended drawings. For the purpose of illustrating the present invention, there is shown in the drawings an embodiment which is presently preferred. It should be understood, however, that the present invention is not limited to the particular arrangement and instrumentalities shown. In the drawings.

DESCRIPTION OF A PREFERRED EMBODIMENT

Figure 1:
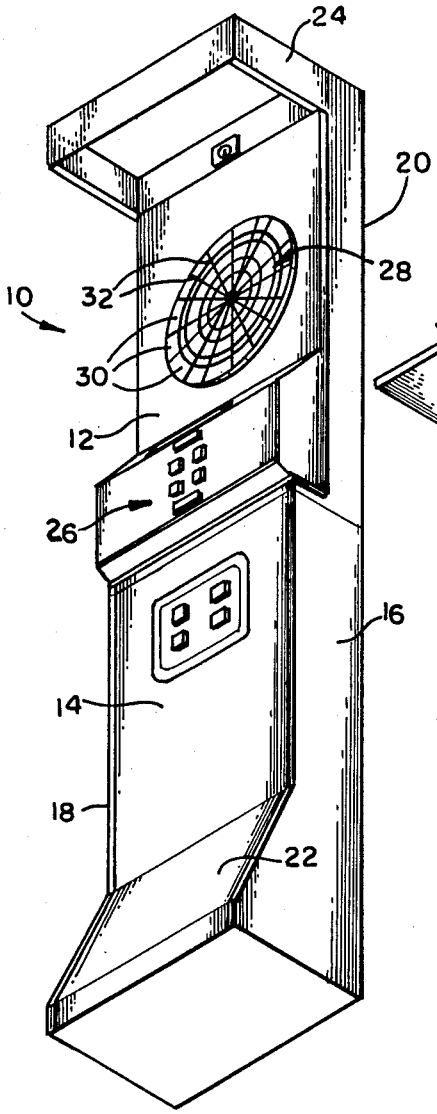
FIG. 1 is a bottom perspective view of an electronically scored dart game with a service door in accordance with the present invention.

Referring to the drawings, wherein like numerals indicate like elements throughout, there is shown in FIG. 1 an electronically scored dart game, generally 10. The dart game 10 is comprised of a generally elongated cabinet or housing 12 having a front surface 14, side surfaces 16 and 18 and a rear surface 20. In the embodiment shown, the lower portion 22 of the housing 12 is wider than the upper portion of the housing to provide enhanced stability and to help prevent the housing 12 from tipping over in the forward direction. In general, the rear surface 20 of the housing 12 is placed against a wall surface so there is little likelihood that the housing will tip over in the rearward direction. The upper portion of the housing includes a generally outwardly extending canopy or cover member 24, which, in addition to being aesthetically pleasing, may include one or more lighting fixtures (not shown) for purposes which will hereinafter become apparent. The housing front surface 14 also includes a plurality of pushbuttons and lights, shown generally as 26, which are used for interaction between the game 10 and the game players.

The primary feature of the housing front surface 14 is the dart board 28. The dart board 28 is comprised of a plurality of generally vertically extending target plates 30. Each target plate, which is formed of a plastic material, has a front surface which includes a plurality of generally circular openings (not shown) for receiving the tip of a dart (not shown) in a manner which is generally well known in the electronically scored dart game art. Each target plate, when struck by a dart, will move rearwardly and activate corresponding electrical contacts (not shown) associated with the housing 12 to indicate a score. The dart board 28 further comprises support means for supporting the target plates 30. In the present embodiment, the support means is comprised of a generally circular support grid or spider 32 which supports the individual target plates 30 in an array substantially the same as a traditional dart board. The support grid or spider 32 generally surrounds each target plate 30, permitting a target plate to move rearwardly when receiving the tip of a dart within one of the target plate openings. The spider 32 includes stop means in the form of a lip (not shown) near its front surface for preventing the target plate 30 from moving toward the front housing surface 14 beyond the spider 32.

The interior of the housing 12 includes electronic means or electronic circuitry 34 for sensing the rearward movement of the target plates 30 and signaling the computer circuitry for determining a score. The electronic circuitry 34 further includes display means, in the present embodiment a cathode ray tube 36, as well as associated circuitry and/or software for displaying the score for each player, as well as additional information relating to the dart game.

The electronically scored dart game 10, as thus far described, is well known in the prior art and is commercially available from a variety of sources, including Merit Industries, Inc., the assignee of the present invention. Further details of the structure and operation of the dart game 10 are not necessary for a complete understanding of the present invention and, therefore, will not be presented herein. Such details are available from the various dart game manufacturers. In addition, general information concerning the structure and operation of the target plates may be obtained by referring to U.S. Pat. No. 4,057,251, the disclosure of which is incorporated herein by reference.

Figure 2:
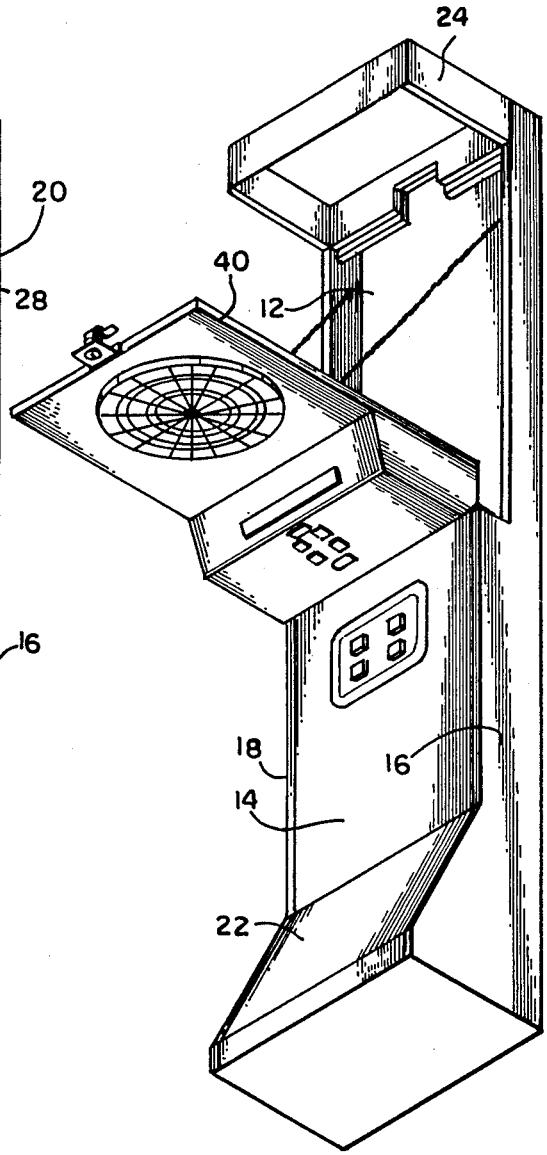
FIG. 2 is a similar bottom perspective view of the dart game of FIG. 1, showing the service door in the service position.
Figure 3:
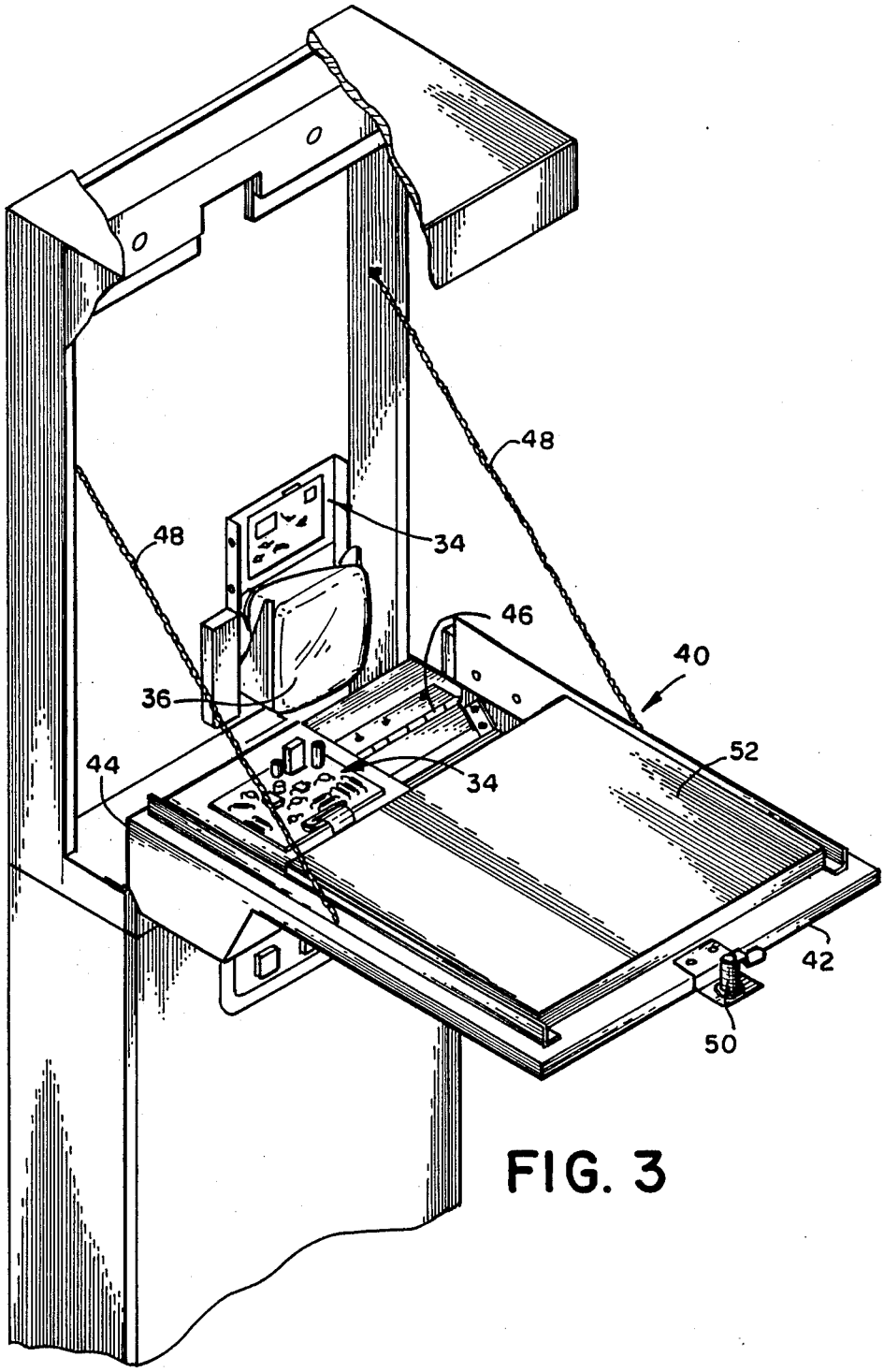
FIG. 3 is an enlarged upper perspective view of a portion of the dart game of FIG. 1 with the service door in the service position.
Figure 4:
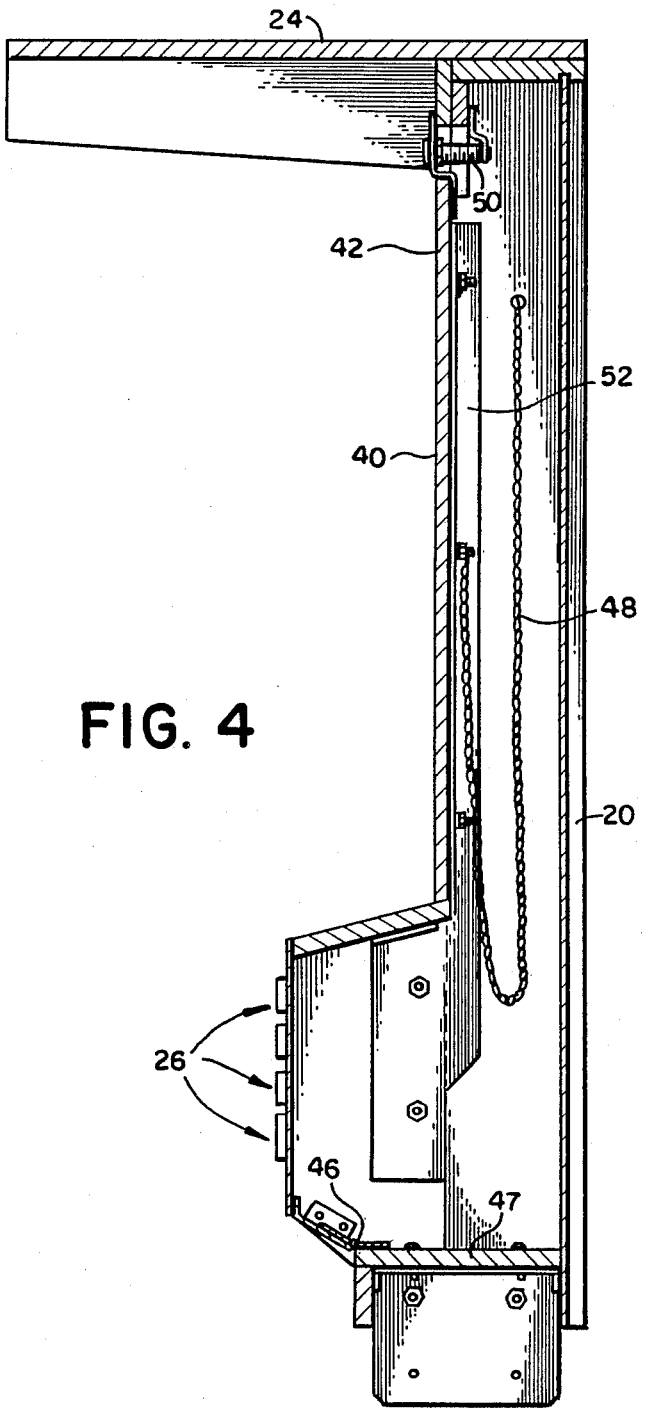
FIG. 4 is a sectional view of an upper portion of the dart game of FIG. 1, with the service door in the operational position.
Figure 5:
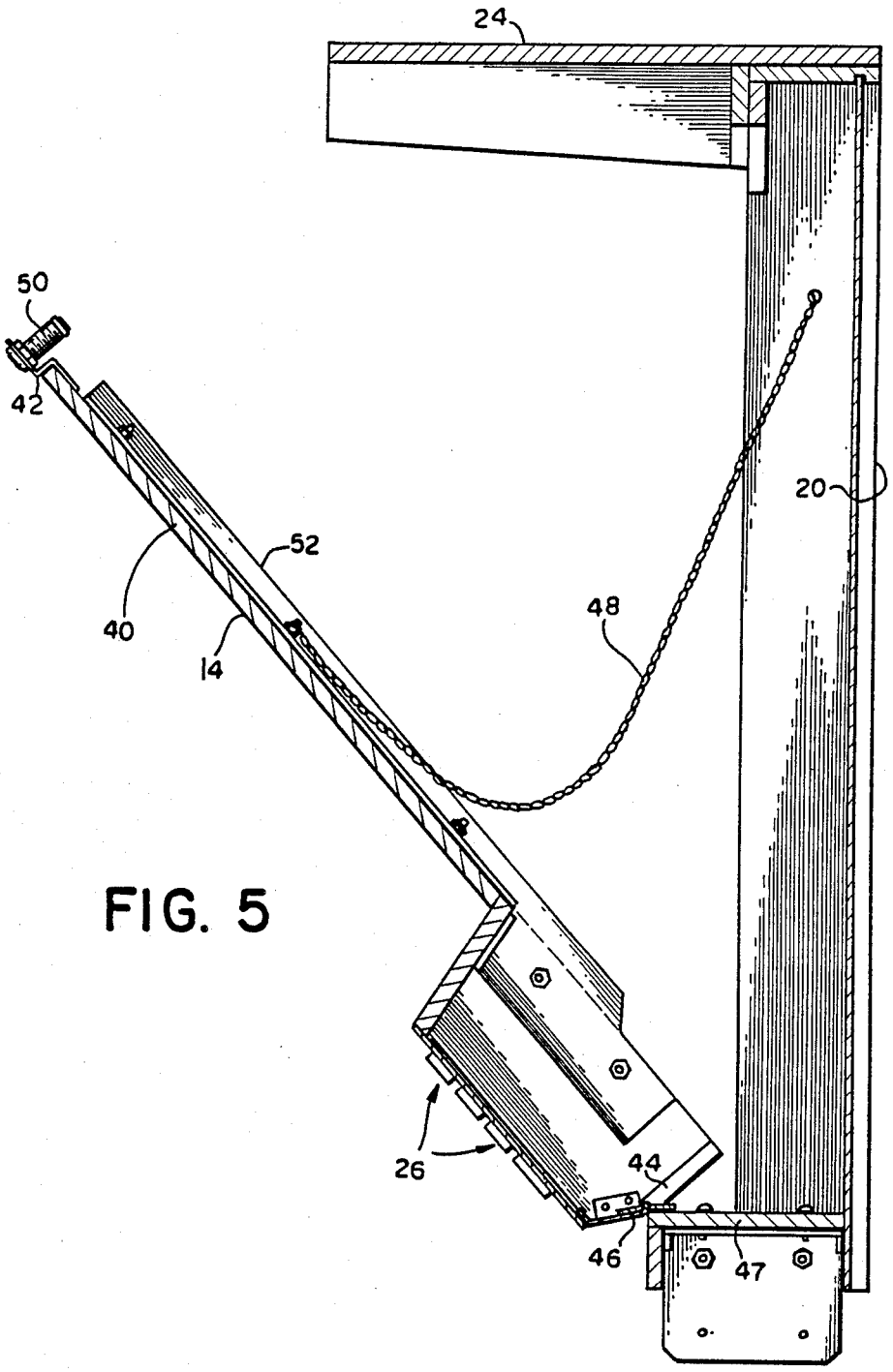
FIG. 5 is a view similar to FIG. 4, with the service door in a partially opened position.

The present invention comprises a service door 40 for providing access to the interior of the housing 12 from the housing front 14. As best seen in FIGS. 2 through 5, the service door is formed of at least a portion of the housing front surface 14 and includes the dart board 28. The service door 40 has an upper end 42 and a lower end 44. As best seen in FIGS. 4 and 5, the lower end 44 of the service door 40 is secured to the housing 12 by a hinge 46 which extends along at least a portion of the service door lower end 44. In the presently preferred embodiment, the hinge 46 is of the piano hinge type and extends substantially along the entire service door lower end 44. One side of the hinge 46 is secured to the service door lower end 44 and the other side of the hinge is secured to a generally horizontally extending member 47 of the housing 12. In this manner, the service door 40 is pivotable about the hinge 46 for movement between an operational position in which the service door 40 is generally vertical, as shown in FIGS. 1 and 4, and a service position in which the service door 40 extends outwardly from the housing front surface 14 at a predetermined angle with respect to the housing front surface 14, as shown in FIGS. 2 and 3. In the presently preferred embodiment, the predetermined angle is approximately 90 degrees, as best shown in FIG. 3. It will be appreciated by those skilled in the art that the predetermined angle may be some other angle less than or greater than 90 degrees, if desired. However, the predetermined angle must be less than 180 degrees, since to permit the service door 42 to pivot through 180 degrees from its operational position, as shown in FIGS. 1 and 4, will result in damage to the front of the service door 40.

Means are provided for preventing the service door 40 from pivoting to a position exceeding the predetermined angle. In the presently preferred embodiment, the means comprises at least one, but preferably two, flexible members 48 extending between the service door 40 and the housing 12. The flexible members 48 are of a predetermined length for permitting the service 40 to extend outwardly from the housing 12 at the predetermined angle, in the present embodiment approximately 90 degrees. The flexible members 48 also serve to support the unattached end of the service door 40 when in the service position. Preferably, the flexible members 48 comprise metallic chains, one end of each chain being secured to the service door 40, generally midway between the upper end 42 and the lower end 44. However, any other type of flexible member could alternatively be employed. The other end of each chain 48 is preferably secured to the housing 12 proximate its upper end. The chains 48 may be secured utilizing screws, bolts or any other suitable attachment means.

As best seen in FIGS. 3, 4 and 5, the lower end 44 of the service door 40 has a predetermined thickness which is substantially greater than the upper end 42 of the service door 40. It should also be noted that the hinge 46 is located near the front surface of the service door 40. In this manner, substantially all of the weight of the service door 40 is located rearwardly of the hinge 46. Accordingly, when the service door 40 is in the operational position, as shown in FIG. 4, the weight of the service door 40 pushes the service door lower end 44 into engagement with member 47 to maintain the service door 40 in the operational position in the absence of the application of an outwardly directed force to the upper end 42 of the service door 40. This is a particularly desirable safety feature which effectively prevents a sudden inadvertent opening of the service door 40, thereby preventing inadvertent damage to the game and/or injury to service personnel. Of course, locking means, in the present embodiment a key operated lock or latch 50 of a type well known in the art, is provided to lock the service door 40 in the operational position to prevent access by unauthorized personnel.

When it is desired to service the electronically scored dart game 10, a service technician inserts a key into the lock 50, unlocking the service door 40. As discussed above, because of the location of the hinge 46 with respect to the weight of the service door 40, the service door 40 remains in the operational position (FIG. 4) even though it has been unlocked. The service technician then pulls outwardly and/or downwardly on the upper end 42 of the service door 40, carefully pivoting the service door 40 about its hinge 46 downwardly to the position as shown in FIGS. 2 and 3, in which the service door is at an angle of approximately 90 degrees with respect to the housing 12. As best shown in FIG. 3, the service technician then has direct access to the electronic circuitry 34, the cathode ray tube 36 and the rest of the interior of the housing 12.

If it is necessary to service the dart board 28, such as for the removal of broken dart tips or the like, the service technician may remove the rear electrical contact panel 52 provided on the service door 40 to expose the rear surface of the target plates 30. The service technician may then service the target plates and/or remove one or more target plates 30, if necessary. However, gravity causes the target plates 30 to engage the stop means on the spider 32 and prevents the target plates 30 from accidentally or inadvertently moving out of the spider 32.

When the service technician has completed servicing the game 10, the service door 40 is pivoted upwardly and the lock 50 is reengaged to lock the service door 40 in the operational position, thereby permitting the playing of the dart game 10.

From the foregoing description, it can be seen that the present invention comprises an electronically scored dart game having a service door which pivots downwardly to provide access to the interior of the housing. It will be appreciated by those skilled in the art that changes and modifications may be made to the above-described embodiment without departing from the inventive concepts thereof. Therefore, it is understood that the present invention should not be limited to the particular embodiment disclosed, but should include all modifications and changes which are within the scope and spirit of the invention as defined by appended claims.

I claim:

1. In an electronically scored dart game having a housing, including a front surface, a dart board on the housing front surface, the dart board comprising a plurality of generally vertically extending target plates, each target plate having a front surface including a plurality of openings for receiving the tip of a dart and having a rear surface, the dart board further comprising support means for supporting the target plates, the support means permitting a target plate to move rearwardly when receiving the tip of a dart within one of said openings, the support means including stop means for preventing the target plate from moving toward the front surface beyond the support means, and electronic means for sensing the rearward movement of the target plates and for determining a score, the electronic means including display means for displaying the score, the improvement comprising:

a service door for providing access to the interior of the housing from the front of the housing, the service door being formed of at least a portion of the housing front surface, including the dart board and having an upper end and a lower end, the service door being hinged to the housing along at least a portion of the lower end, whereby the service door is pivotable about the hinge for movement between a generally vertical operational position and a service position in which the service door extends outwardly from the front surface of the housing at a predetermined angle of less than 180 degrees, the service door including means for preventing the service door from pivoting to a position exceeding the predetermined angle, when in the service position gravity causes the target plates to engage the stop means and prevents the target plates from moving rearwardly with respect to the support means.

2. The electronically scored dart game as recited in claim 1, wherein the predetermined angle is approximately 90 degrees.

3. The electronically scored dart game as recited in claim 1, further comprising locking means for retaining the service door in the operational position.

4. The electronically scored dart game as recited in claim 1, wherein the means for preventing the service door from pivoting beyond the predetermined angle in the service position comprises at least one flexible member extending between the service door and the housing, the flexible member being of a predetermined length for permitting the service door to extend outwardly from the housing at the predetermined angle.

5. The electronically scored dart game as recited in claim 4, wherein the flexible member comprises a chain, one end of the charn being secured to the service door generally midway between the upper and lower ends, the other end of the chain being secured to the housing proximate an upper end.

6. The electronically scored dart game as recited in claim 1, wherein the hinge is positioned in a manner so that, when the service door is in the operational position, in the absence of the application of an outwardly directed force, the weight of the service door maintains the service door in the operational position.

7. The electronically scored dart game as recited in claim 6 wherein at least the lower end of the service door has a predetermined thickness and wherein the hinge is located generally proximate the front housing surface.

* * * * *